United States Patent [19]

Schupp

[11] 4,340,841

[45] Jul. 20, 1982

[54] INTERNAL SHUNT FOR SERIES CONNECTED LAMPS

[75] Inventor: Lewis J. Schupp, Chesterland, Ohio

[73] Assignee: General Electric Company, Schenectady, N.Y.

[21] Appl. No.: 152,425

[22] Filed: May 22, 1980

[51] Int. Cl.[3] ..... H01J 7/44; H01J 17/34; H01J 19/78; H01J 29/96

[52] U.S. Cl. ..... 315/75; 313/315; 315/123

[58] Field of Search ..... 315/75, 74, 122, 123, 315/125; 313/315

[56] References Cited

U.S. PATENT DOCUMENTS

| | | | |
|---|---|---|---|
| 1,803,486 | 5/1931 | Rau, Jr. | 315/75 |
| 1,992,844 | 2/1935 | Severin et al. | 315/75 |
| 2,576,363 | 11/1951 | Rively et al. | 315/122 |
| 3,458,756 | 7/1969 | Kotsch | 315/75 |
| 3,794,880 | 2/1974 | Peretti et al. | 315/75 |
| 3,912,966 | 10/1975 | Harnden, Jr. | 315/122 |
| 4,233,543 | 11/1980 | Hickok | 315/75 |

*Primary Examiner*—Saxfield Chatmon, Jr.
*Attorney, Agent, or Firm*—John F. McDevitt; Philip L. Schlamp; Fred Jacob

[57] ABSTRACT

An improved operation shunt for series connected incandescent-type lamps is disclosed utilizing a novel shunt material composition comprising an admixture of conductive metal particulates, an inorganic binder, and conductive non-metallic particulates and which is adhesively bonded to an insulative bead member interconnecting the spaced apart lamp inleads.

10 Claims, 2 Drawing Figures

INTERNAL SHUNT FOR SERIES CONNECTED LAMPS

BACKGROUND OF THE INVENTION

This invention relates to incandescent lamps of various types which are to be used in a series circuit, such as decorative string sets for holiday lighting or even an incandescent lamp which has been electrically connected in series with some other electrical device wherein a resistance characteristic of said incandescent lamp in the particular electrical circuit is desired to be maintained even after the incandescent lamp filament has failed. More particularly, the present invention pertains to a novel internal shunt construction for these type incandescent lamps.

Internal shunt constructions for incandescent lamps are already known and most commonly used in holiday lighting strings electrically connected in a series circuit. One type shunt employs a number of turns of fine anodized aluminum wire wound about the inner lead-in wires of the lamp wherein the anodized oxide coating acts as an electrical insulator. If the incandescent lamp filament should fail, then the supply voltage to the lamp is impressed across the shunt member which causes dielectric breakdown of the oxide coating along the shunt member to operate as an electrical conductor and preserving the resistance characteristics of the incandescent lamp. The shunt member is designed so that the breakdown voltage of the oxide coating is lower than the supply voltage to the incandescent lamp. Understandably, wide variation in the breakdown voltage is undesirable since the lamps cannot be replaced in many integral string sets. Another significant problem arises with fluctuation in the electrical resistance characteristics of this type shunt construction which can undesirably influence operation of other electrical devices in the series circuit. An improved shunt construction demonstrating more uniformity in the dielectric breakdown voltage and electrical resistance characteristics is disclosed in Pat. Appln. Ser. No. 859,056, filed Dec. 9, 1977, in the name of R. L. Hickok, and assigned to the present assignee, which utilizes two strips of anodized aluminum foil that are fastened together around the inner lead-in wires of an incandescent lamp. In said shunt construction, the glass bead member used to support and locate the inner lead-in wires can be eliminated and the shunt member may comprise a single long strip folded in half about the lead-in wires. A more reliable shunt is obtained in this manner, and the shunt member itself can be easily manufactured automatically.

Mechanical placement of both above type shunt members in the proper location within the lamp device has also proven to be a difficult procedure. Unless both types shunt members are properly secured between the lamp inleads, there can also be unreliable shunt operation as well as possible interference with the normal lamp operation before the filament burns out. If the above identified foil shunt construction is used to replace the conventional glass bead support which spaces apart the lamp inleads, normal lamp operation could cease if the foil member becomes unfastened. Additionally, normal manufacturing variation in the voltage breakdown and electrical resistance characteristics of both these type shunt members is encountered which can have an adverse effect upon the shunt operation.

It would be desirable, therefore, to provide a still further improved shunt member construction which is less subject to all of the foregoing indicated difficulties. It would also be desirable to provide such improved shunt member construction requiring little modification in the otherwise conventional lamp manufacture.

SUMMARY OF THE INVENTION

A shunt member construction has now been discovered in the form of a material admixture which is adhesively bonded to the insulated bead member spacing apart the inner lamp inleads so as to interconnect said inleads. Specifically, said shunt material composition comprises an admixture of conductive metal particulates, an inorganic binder, and conductive non-metallic particulates in the proportions needed to provide uniform and stable voltage breakdown and electrical resistance characteristics. Briefly stated, the voltage breakdown characteristic in the present shunt material composition is fixed primarily by the relative proportions between the conductive metal substance and the conductive non-metallic substance selected although further influenced by the particle size of these powdered materials. The applied voltage value at which the present shunt member construction breaks down to serve as an electrical conductor depends upon the electrical circuit in which the lamp is series connected and it is selected to be less than the applied voltage to the particular electrical circuit. The electrical resistance characteristic of the present shunt material composition is also determined primarily by the relative proportions between the conductive metal particulates and conductive non-metallic particulates in said composition with the absolute resistance value for the shunt member construction being fixed to approximate the electrical resistance value for the associated lamp filament.

Useful conductive metals which can be employed in powder form for the present shunt material composition include aluminum, silver and other good electrically conductive metals which maintain stable voltage breakdown and electrical resistance characteristics during exposure to the lamp operating environment. Powdered copper metal has not proven useful in the present shunt material composition by reason of unstable oxide formation causing variation in the desired electrical characteristics. Useful conductive non-metallic substances in the present shunt material composition can be selected from the class of electrical semiconductors such as powdered carbon as well as inorganic compounds exhibiting stable semiconductive properties when exposed to the lamp operating environment. The inorganic binder used in the present shunt material composition can be selected from the class of vitreous inorganic oxides which are chemically unreactive in the lamp operating environment such as boric oxide and various silicate glass compositions.

In its broadest sense, the present improvement is an incandescent lamp having a light-transmitting envelope, a refractory metal filament connected between a pair of metal inleads, and said inleads being spaced apart by an electrically insulative bead member, wherein the improvement resides in a shunt material comprising an admixture of conductive metal particulates, an inorganic binder, and conductive non-metallic particulates, that is adhesively bonded to said insulative bead member interconnecting the spaced apart inleads. A preferred shunt material composition comprises in parts by weight approximately 60–90 parts powdered aluminum metal, approximately 10–40 parts boric oxide, and approximately 1–10 parts carbon powder. A preferred incandescent lamp embodiment utilizes a light-transmitting glass envelope composition, a tungsten metal filament connected between said pair of metal inleads, said inleads also being spaced apart by a glass bead member, and said lamp glass envelope being hermetically sealed to said inleads, and wherein the present shunt material composition is adhesively bonded to said glass member interconnecting said spaced apart inleads.

DETAILED DESCRIPTION OF THE PREFERRED EMBODIMENT

Figure 1:
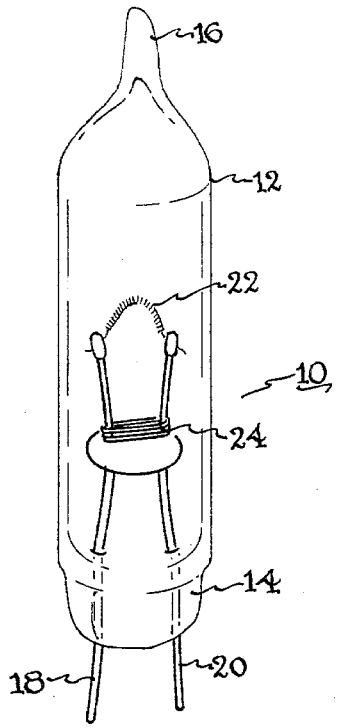
Fig. 1 PRIOR ART
FIG. 1 is a cross-sectional view of a prior art incandescent lamp utilizing a wire-wound shunt member.

Referring to FIG. 1, a known wire lamp 10 is depicted at the stage of lamp manufacture where the lamp envelope is sealed but no base or fastening means has been provided. Specifically, said lamp comprises a light-transmitting vitreous envelope 12 having a sealed area 14 and an exhaust residue 16. Lead-in wire members 18 and 20 are hermetically sealed at the sealed area 14 and connected at the opposite ends of said inleads to a tungsten filament 22 all in conventional fashion. Shunt member 24 comprises anodized aluminum wire wound, usually by hand, about the inner lead wires of said lamp construction. As previously indicated, the oxide covering of said aluminum wire serves as an electrical insulator which breaks down when the lamp applied voltage is impressed across the wire coil and the breakdown voltage is roughly proportional to the oxide thickness. Accordingly, when said lamp is connected in series string sets such as used in holiday lighting and assuming the filaments of all the lamps in the string set are intact, the voltage on the shunt member is approximately the nominal voltage of the lamp, that is, 6 volts for a 20-lamp string. If a filament should open, then the full supply voltage is across the shunt. In theory, the shunt is designed so that the breakdown voltage to the oxide is lower than the supply voltage. In practice, however, the design breakdown voltage is only nominal, that is, there are variations in breakdown voltage from lamp to lamp due to the manufacturing process.

Figure 2:
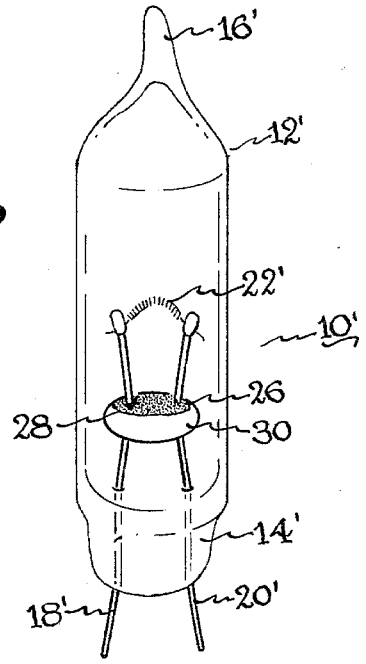
FIG. 2 is a cross-sectional view of the same type lamp construction utilizing the presently improved shunt member construction.

FIG. 2 illustrates the same type lamp configuration above described but which employs the improved shunt member construction of the present invention. Specifically, said wire lamp 10' is again shown at the stage of lamp manufacture where the lamp envelope is sealed but no base or fastening means has been provided. Said lamp further comprises a light-transmitting vitreous envelope 12' having sealed area 14' and an exhaust residue 16'. The lead-in wire members 18' and 20' are hermetically sealed at the sealed area 14' and connected at the opposite end of said inleads to a tungsten filament 22' all again in conventional fashion. The shunt member 26 is of a different construction, however, wherein a mass 28 of the present shunt material admixture is adhesively bonded to a glass bead member 30 so that an electrical connection can be established between said inlead wires. A burnout of the lamp filament 22' applies the lamp voltage across said mass of shunt material resulting in breakdown of said material to an electrically conductive state exhibiting approximately the same resistance value as the lamp filament before burnout. Deposition of the shunt material on the glass bead member is accomplished routinely during lamp manufacture before hermetically sealing the mounted filament to the lamp glass envelope.

The operational characteristics of the present shunt member construction can be illustrated by voltage breakdown measurements made upon these shunt members before and after construction of the above described lamps. Specifically, variation in a preferred shunt material composition is reported in Table I below along with the breakdown voltage measurements carried out on representative samples of the filamentless mounts as well as the finished lamps. The filamentless mounts were constructed in the ordinary manner and the shunt material deposited on the glass bead between the mounted inleads followed by oven drying of the deposited shunt material for approximately 20 minutes at 100° C.

TABLE I

| | Shunt Material Composition (Parts by Weight) | | | Breakdown Voltage (Volts) | |
|---|---|---|---|---|---|
| Example | Aluminum | Boric Acid | Carbon | Mount | Lamp |
| 1 | 90 | 10 | 1 | 89 | 71 |
| 2 | 60 | 40 | 1 | 130+ | 114 |
| 3 | 90 | 10 | 4 | 46 | 24 |
| 4 | 60 | 40 | 4 | 66 | 54 |

As can be noted from the above reported breakdown voltage measurements, a small decrease in breakdown voltage occurs after lamp manufacture possibly attributable to removing water from the boric acid binder during lamp manufacture. In conducting said tests, it was also noted that variations in the breakdown voltage values did not exceed 10% between samples of the same shunt material composition which represents considerable improvement compared with prior art shunts. It can be further noted from the above reported test results that the carbon content in the preferred shunt material composition provides an effective means to vary the breakdown voltage characteristic allowing electrical conduction thereafter between the aluminum metal particles. The aluminum metal particles in these test compositions averaged 2–5 microns diameter in size whereas the carbon powder in these compositions averaged 0.001–0.01 micron diameter in size.

Other modifications in the present shunt material composition provide still further benefits. Small additions of silicon metal can provide increased electrical resistance during shunt operation with increased lamp operating temperature which can serve as means to reduce overloading other lamps in the series circuit. Addition of other inorganic oxides to the present shunt material composition can serve a still different purpose. For example, barium chromate and iron oxide additions, produce an exothermic reaction during shunt operation so that an open fuse function can be obtained thereby in the series circuit if desired. Other inorganic compounds which can be converted to vitreous oxides such as potassium phosphate may also be added to the preferred shunt material composition to improve adhesion of the shunt member to a glass bead substrate.

It will be apparent from the foregoing description that a more reliable and more easily manufactured shunt construction has been provided for series connected incandescent-type lamps. It will be apparent to those skilled in the art, however, that various modifications can be made in the present shunt construction other than the above specifically disclosed within the spirit and scope of the present invention. For example, providing a depression or contour in the insulated bead member of the lamp construction to enhance containment and/or adhesion of the present shunt material composition is also contemplated. It is intended to limit the present invention, therefore, only by the scope of the following claims.

What I claim as new and desire to secure by Letters Patent of the United States is:

1. In an incandescent lamp having a light-transmitting envelope, a refractory metal filament connected between a pair of metal inleads and said inleads being spaced apart by an electrically insulative bead member, the improvement wherein a shunt material comprising an admixture of conductive metal particulates, an inorganic binder, and conductive non-metallic particulates exhibiting voltage breakdown behavior, is adhesively bonded to said insulative bead member interconnecting and in physical contact with both spaced apart inleads, wherein the proportions in said admixture are maintained so that electrical conduction continues to take place between the metal particles after the breakdown voltage has been exceeded.

2. A lamp as in claim 1 wherein the conductive metal particulates are powdered aluminum.

3. A lamp as in claim 1 wherein the inorganic binder is boric oxide.

4. A lamp as in claim 1 wherein the conductive non-metallic particulates are carbon powder.

5. A lamp as in claim 1 wherein the shunt material comprises in parts by weight approximately 60–90 parts powdered aluminum, approximately 10–40 parts boric oxide, and approximately 1–10 parts carbon powder.

6. In an incandescent lamp having a light-transmitting glass envelope, a tungsten metal filament connected between a pair of metal inleads, said inleads being spaced apart by a glass bead member, and said lamp glass envelope being hermetically sealed to said inleads, the improvement wherein a shunt material comprising an admixture of conductive metal particulates, an inorganic binder, and conductive non-metallic particulates exhibiting voltage breakdown behavior is adhesively bonded to said glass bead member interconnecting and in physical contact with both spaced apart inleads wherein the proportions in said admixture are maintained so that electrical conduction continues to take place between the metal particles after the breakdown voltage has been exceeded.

7. A lamp as in claim 6 wherein the conductive metal particulates are powdered aluminum.

8. A lamp as in claim 6 wherein the inorganic binder is boric oxide.

9. A lamp as in claim 6 wherein the conductive non-metallic particulates are carbon powder.

10. A lamp as in claim 6 wherein the shunt material comprises in parts by weight approximately 60–90 parts powdered aluminum, approximately 10–40 parts boric oxide, and approximately 1–10 parts carbon powder.

* * * * *